United States Patent [19]

Trautman

[11] 4,089,179

[45] May 16, 1978

[54] SHORELINE EROSION CONTROL

[76] Inventor: Frank A. Trautman, 1448 Bishop St., Benton Harbor, Mich. 49022

[21] Appl. No.: 800,195

[22] Filed: May 25, 1977

Related U.S. Application Data

[63] Continuation-in-part of Ser. No. 741,846, Dec. 27, 1976, abandoned.

[51] Int. Cl.[2] ..... E02B 3/04

[52] U.S. Cl. ..... 61/3; 61/5; 256/12.5

[58] Field of Search ..... 61/3, 1 R, 4, 5, 37; 256/12.5, 21, 24; 244/114 B

[56] References Cited

U.S. PATENT DOCUMENTS

| | | | |
|---|---|---|---|
| 534,545 | 2/1895 | Breadner | 256/12.5 |
| 762,727 | 6/1904 | Landenberger | 61/4 |
| 1,060,357 | 4/1913 | Nies | 61/3 |
| 1,748,444 | 2/1930 | Dutton | 61/3 |
| 2,710,505 | 6/1955 | Magill | 61/4 |
| 3,011,316 | 12/1961 | Wilson | 61/4 |

*Primary Examiner*—Dennis L. Taylor
*Attorney, Agent, or Firm*—Blanchard, Flynn, Thiel, Boutell & Tanis

[57] ABSTRACT

A shoreline erosion control device having a frame fixed to the ground along the shoreline of a body of water and in the path of the wave action on the body of water. A plurality of screened louvers are pivotally secured to the frame and are adapted to pivot to the open position on the side of the frame facing away from the body of water during movement of a wave therepast. A return of the water in the wave toward the body of water will effect a closing of the screened louver and any sand that will be contained in the returning water will be strained by the screened louvers. The slightly restrictive openings in the mesh will slow the water velocity and allow the large grains of sand and soil to fall on the landward side of the screened louvers and due to the slowing of the wave action the sand particles that pass through the screen to fall on the seaward side of the device thus creating a gentle slope to the bottom.

3 Claims, 4 Drawing Figures

SHORELINE EROSION CONTROL

CROSS REFERENCE TO RELATED APPLICATION

This is a continuation-in-part of application Ser. No. 741,846, filed Dec. 27, 1976 now abandoned.

FIELD OF THE INVENTION

This invention relates to an erosion control device and, more particularly, relates to a shoreline erosion control device which is mounted in a body of water in the path of the wave action and permits the free flow of water through the device toward the shoreline and strains the water as it moves away from the shoreline to remove particles of sand contained therein to effect a building-up of the floor of the body of water adjacent the shoreline erosion control device.

BACKGROUND OF THE INVENTION

Various devices are known for controlling the erosion of soil adjacent the shoreline of a body of water. It is also known to place these devices into the body of water to control the force of the water acting on the soil. However, the power of the moving water has in the past been greatly underestimated and after a period of use of the devices in the water, the wave force eventually effects a destruction of the device.

Accordingly, it is an object of this invention to provide a shoreline erosion control device which will not be susceptible to destruction by wave action forces but yet permit a buildup of sand particles in and around the device to prevent wave action forces from acting onto the shoreline soil which is to be preserved.

It is a further object of this invention to provide a shoreline erosion control device that is mounted in the body of water in the path of the wave action on the body of water and providing structure for straining the sand particles contained in the water as the water moves away from the shoreline to keep the sand particles on the side of the device closest to the shoreline to effect the creation of a gentle slope from the device toward the bottom of the body of water.

SUMMARY OF THE INVENTION

In general, the objects and purposes of the invention are met by providing a shoreline erosion control device which has a frame fixed to the ground along the shoreline of a body of water and in the path of the wave action on the body of water. A plurality of screened louvers are pivotally secured to the frame and adapted to pivot into the open position on the side of the frame facing away from the body of water during movement of a wave therepast. A return of the water toward the lake will effect a closing of the screened louvers so that any sand that will be contained in the returning water will be strained by the screened louvers. The slightly restrictive openings in the mesh of the screen will slow the water velocity and allow the large grains of sand and soil to fall on the landward side of the screened louvers and due to the slowing of the wave action, the sand particles that pass through the screen will fall on the seaward side of the device, thus creating a gentle slope to the bottom.

BRIEF DESCRIPTION OF THE DRAWING

Further objects and purposes of the invention will be apparent to persons acquainted with apparatus of this general type upon reading the following specification and inspecting the accompanying drawing, in which.

Figure 1:
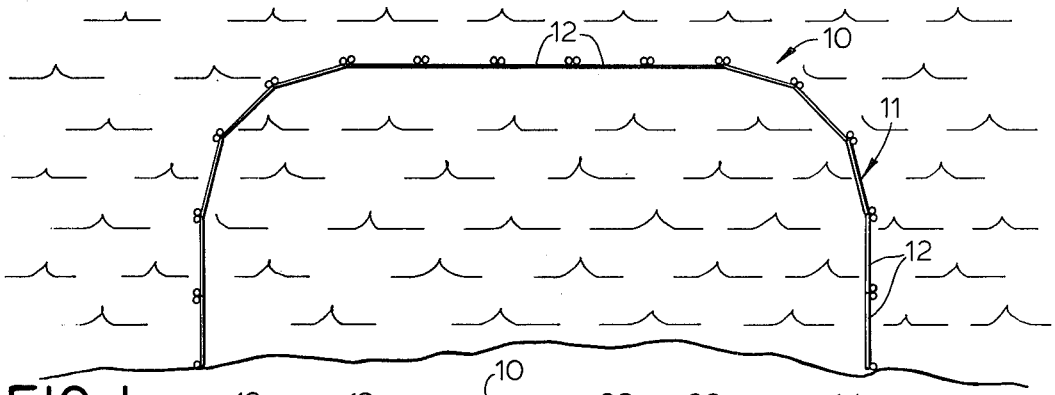
FIG. 1 is a top view of a shoreline erosion control device embodying my invention.

Certain terminology will be used in the following description for convenience in reference only and will not be limiting. The words "up" and "down" will designate directions in the drawing to which reference is made. The words "in" and "out" will refer to directions toward and away from, respectively, the geometric center of the device and designated parts thereof. Such terminology will include the words above specifically mentioned, derivatives thereof and words of similar import.

DETAILED DESCRIPTION

An erosion control device 10 embodying my new invention is illustrated in FIG. 1. The erosion control device 10 is comprised of a barrier-like member 11 having a plurality of individual barrier sections 12. Each barrier section consists of a pair of horizontally spaced and upright vertical posts 13 and 14 which are driven into the ground. The spacing between the posts 13 and 14 is carefully controlled during the period of time that they are driven into the ground. A plurality of louver sections 16 are mounted on the posts 13 and 14. Each louver section 16 is comprised of a pair of tubular end members 17 and 18, each of which has a pivot bearing 19 and 21, respectively, thereon. Each end member has an opening therethrough for receiving a post therein. Each louver section also consists of a screened panel 22 having a rectangular shaped frame 23 and an elongated axle 24 mounted thereon and secured thereto by any convenient means, as by welding. The axle 24 extends along one edge of the rectangular frame 23, preferably the upper edge. The rectangular frame 23 has a mesh screen member 26 secured thereto by any convenient means. If the mesh is a wire screen, the wire screen can be welded to the frame 23. The ends of the axle 24 extend beyond the width of the frame 23 and are received in the pivot bearings 19 and 21. The length of the axle 24 is also greater than the horizontal spacing between the pivot bearings 19 and 21 when the end members 17 and 18 are mounted on the posts. As a result, once the panels 22 are mounted so that the axle 24 is in engagement with the pivot bearings 19 and 21, the tubular end members 17 and 18 will not be permitted to rotate about the axis of the posts 13 and 14 due to the engagement by the pivot bearings 19 and 21 with the surface of the axle 24.

Figure 2:
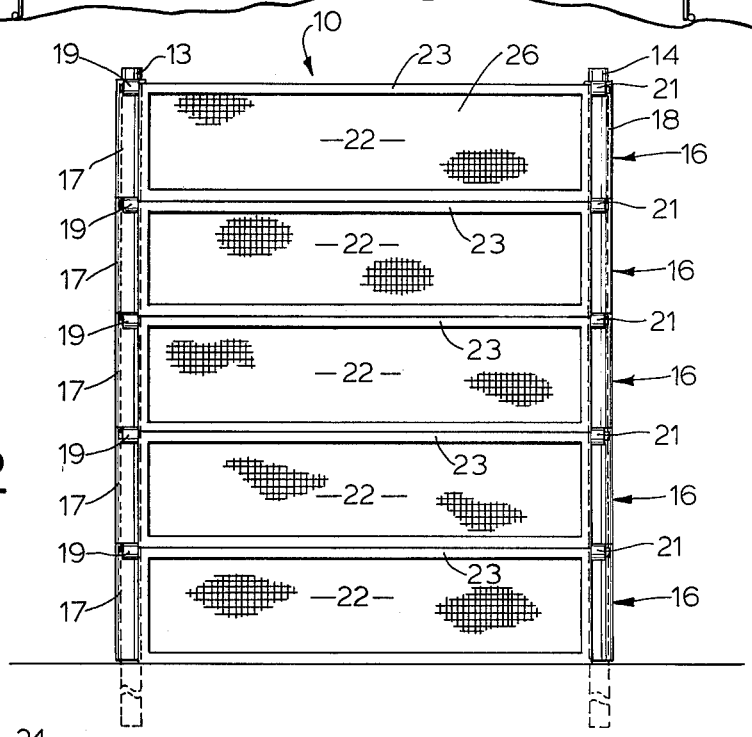
FIG. 2 is a front elevational view of an individual barrier section embodying my invention.
Figure 3:
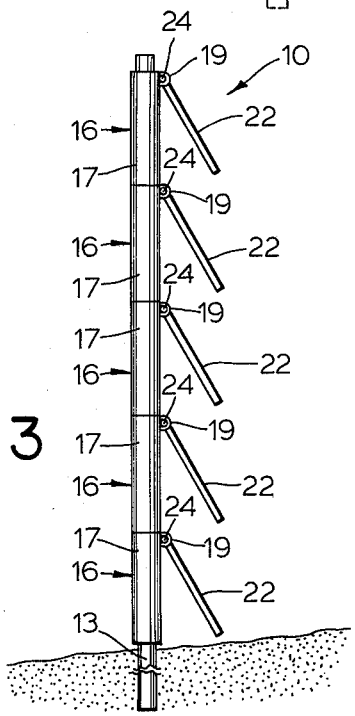
FIG. 3 is a side elevational view of the barrier section in FIG. 2.
Figure 4:
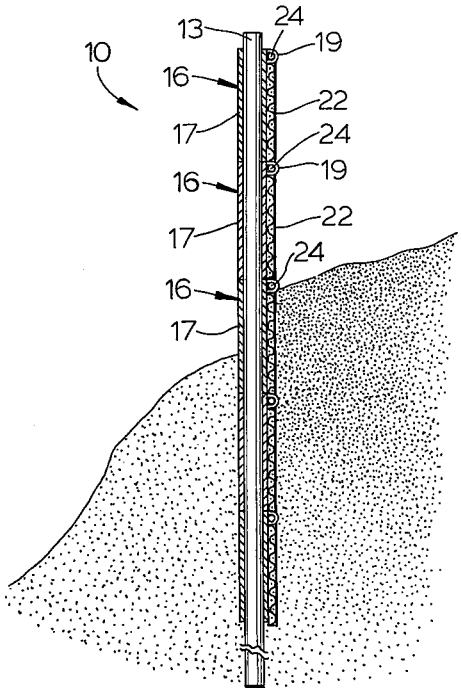
FIG. 4 is a central sectional view through an end segment of the barrier section.

A plurality of louver sections 16 are stacked one on top of the other with the end members 17 and 18 receiving the posts 13 and 14 therein as illustrated in FIG. 2. In use, the panels 22 are positioned on the inland side of the posts 13 and 14, that is, on the side toward the shoreline which is to be preserved. As a result, wave action from the body of water will move through the barrier sections 12 and cause the individual panels 22 to pivot about the axis of the axle 24 to the position illustrated in FIG. 3 to facilitate the free passage of water therethrough. However, on the return movement of the water from the wave toward the body of water away from the shoreline, each of the individual panels 22 will become closed and the mesh 26 contained therein will effect a straining of the sand particles contained within the water. Not all of the sand particles will be effectively removed from the water. Only the sand particles which are larger in size than the size of the mesh utilized in the panels 22 will be removed. The larger sand particles will, therefore, drop from the screen at the end of the wave action and eventually the larger particles will collect into a mass and effectively cause the build-up of sand particles on the shoreline side of the erosion control device 10. Eventually, enough sand will have collected on the shoreline side of the erosion control device 10 that some of the louver sections 16 will be blocked in the closed position as illustrated in FIG. 4 wherein three such louver sections 16 are blocked in the closed position. The water velocity of the returning water through the mesh 26 will also be effectively slowed so that the finer sand particles passing through the mesh will drop downwardly and collect on the side of the erosion control device facing away from the shoreline. The upper louver sections 16 will still be functional to open as an incoming wave moves therethrough and will close as the water from the wave attempts to return toward the center of the body of water.

The mesh utilized in the construction of my erosion control device 10 can be selectively controlled. I have noted that the grain size of sand particles varies from one body of water to another as well as in accordance to the latitude. For example, sand particles along the eastern shore of Lake Michigan vary substantially from the southern end of the lake in Indiana to the northern end adjacent the northern end of the Lower Peninsula. For example, the A.F.S. fineness number for sand found in the Gary, Ind. and Michigan City areas of Lake Michigan is 69, whereas the same number for sand in and around the Traverse City and Petoskey, Michigan is 43. As a result, the size of the mesh in one area will not be effective for use in another area. As a result, I can control the effective size of the mesh to effect the building up of sand particles in any desired area along a body of water.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are as follows:

1. A shoreline erosion control device, comprising:

a frame fixed to the ground along the shoreline of a body of water and in the path of the wave action on the body of water; and a plurality of selected screened louvers releasably pivotally secured to said frame and being pivotal to the open position on the side of the frame facing away from the body of water during movement of a wave therepast, each of said plurality of screened louvers consisting of a selected mesh, the size of the openings therein being selectively controlled to strain sand particles and effect the building up of sand particles of a predetermined size, a return of the water in the wave toward the lake effecting a closing of the screened louver so that any sand that will be contained in the returning water will be strained by the screened louvers, the slightly restrictive openings in the mesh of said screen slowing the water velocity and allowing the large grains of sand and soil to fall on the landward side of the screened louvers and due to the slowing of the wave action the sand particles that pass through the screen to fall on the seaward side of the device thus creating a gentle slope to the bottom.

2. A shoreline erosion control device according to claim 1, wherein said frame includes a pair of horizontally spaced posts driven into the ground;

wherein each of said plurality of screened louvers is comprised of a pair of spaced tubular end members having bearing means thereon for pivotally supporting said screened louvers; and wherein said screened louvers comprise a rectangular shaped panel having an axle secured thereto, said axle being received in said bearings to render said panel pivotal with respect to said tubular end members and a mesh secured to said frame.

3. A shoreline erosion control device according to claim 2, including a plurality of pairs of posts, each having a plurality of screened louvers thereon to define an enclosed body of water in which sand particles are to be collected.

* * * * *